US006270185B1

(12) United States Patent
Askeland

(10) Patent No.: US 6,270,185 B1
(45) Date of Patent: Aug. 7, 2001

(54) VERY-HIGH-RATIO MIXED RESOLUTION AND BIPHOD PENS FOR LOW-COST FAST BIDIRECTIONAL ONE-PASS INCREMENTAL PRINTING

(75) Inventor: Ronald A. Askeland, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/384,735

(22) Filed: Aug. 27, 1999

(51) Int. Cl.[7] ..... B41J 2/145; B41J 2/15; B41J 29/38

(52) U.S. Cl. ..... 347/40; 347/9

(58) Field of Search ..... 347/40, 65, 71, 347/85, 43, 9

(56) References Cited

U.S. PATENT DOCUMENTS

| | | | | |
|---|---|---|---|---|
| 5,278,584 | | 1/1994 | Keefe et al. | 347/40 |
| 5,541,625 | | 7/1996 | Holstun et al. | 347/5 |
| 5,742,306 | * | 4/1998 | Gompertz et al. | 347/43 |
| 5,912,683 | * | 6/1999 | Eade | 347/40 |
| 5,975,677 | * | 11/1999 | Marler et al. | 347/40 |
| 5,984,455 | * | 11/1999 | Anderson | 347/47 |
| 6,039,438 | * | 3/2000 | Beerling | 347/63 |

* cited by examiner

*Primary Examiner*—Thinh Nguyen

(57) ABSTRACT

An incremental printer, such as for example an inker printer, produces very small markings (as for example by firing small ink droplets) preferably in a single-pass print mode for text, as well as image applications if desired, to achieve addressable print resolution at least four times higher in the carriage scan axis than in the media advance axis. More preferably the resolution in the scan axis is at least six times, ideally eight times, higher than that in the media advance axis. A preferred form of the invention uses 96 dots/mm (2400 dpi) resolution in the scan axis, in conjunction with only 12 dots/mm (300 dpi) resolution in the media advance axis, without having to employ any dot-depletion algorithms. In one embodiment, the system provides a single-pass color print mode wherein primary colors are printed with eight color droplets of the same primary color in eight adjacent sub-pixels on the 300×2400 grid, and secondary colors are printed with eight color droplets of different primary colors in eight adjacent subpixels on the same grid. One implementation uses a pen with a single tab-head assembly, with nozzles in plural parallel staggered columns, receiving ink from plural different ink reservoirs. Two such pens provide four inks for color inker printing. Three or more such pens enable a printing system to supply ink of plural dilutions for at least one of the ink colors in the system, and thereby facilitate photographic-quality printing.

25 Claims, 6 Drawing Sheets

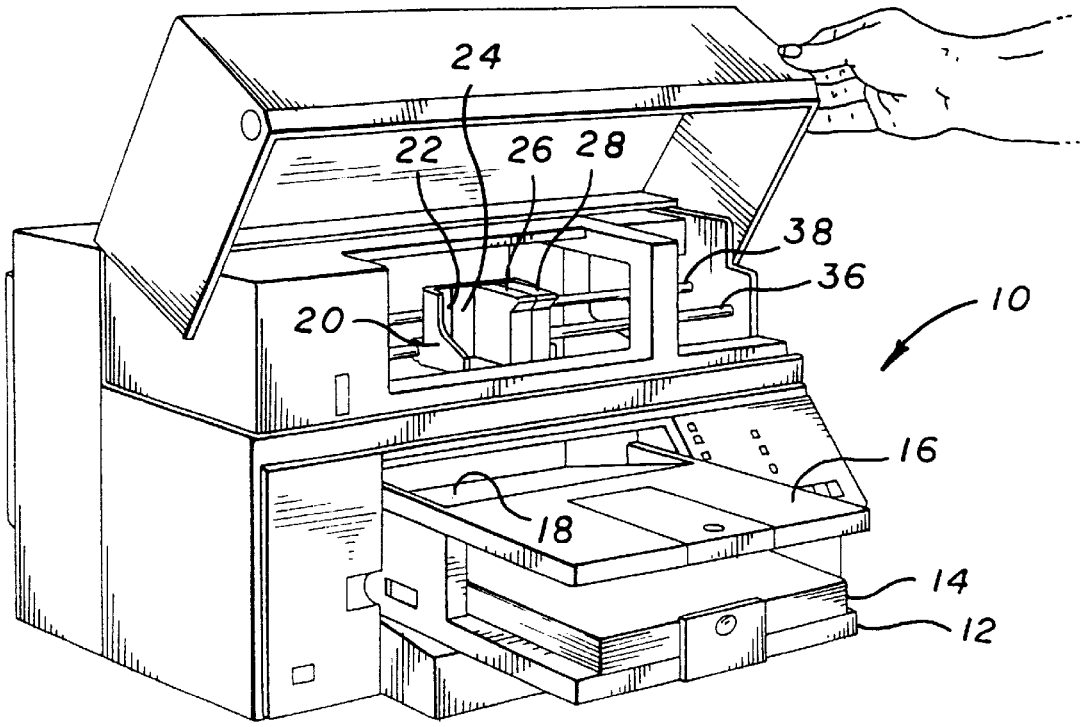
FIG. 1
FIG. 2
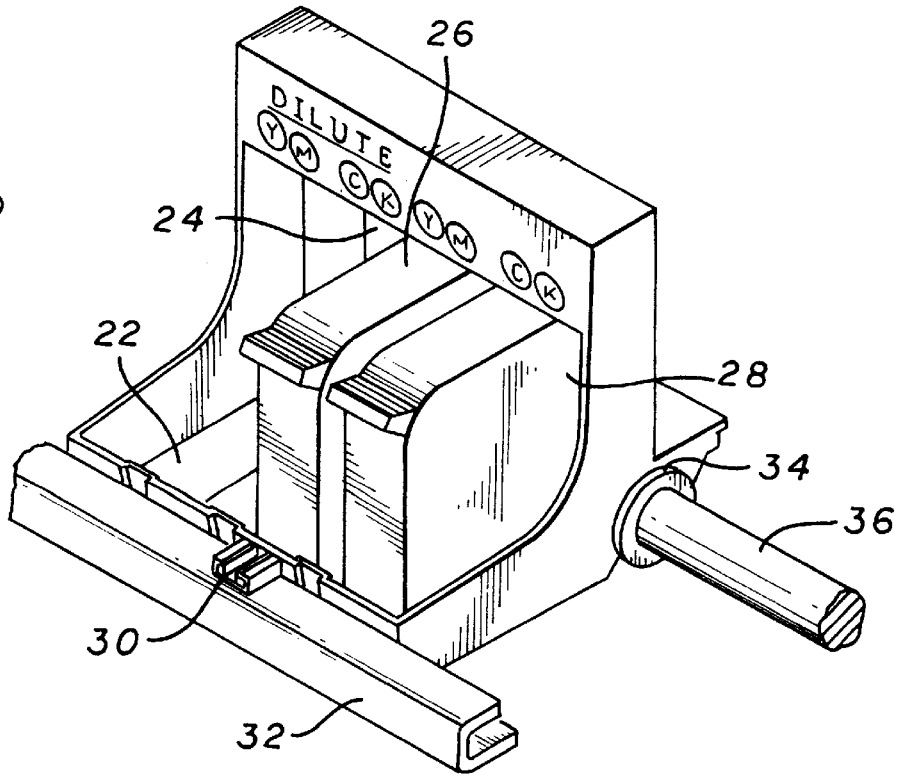

FIG. 8
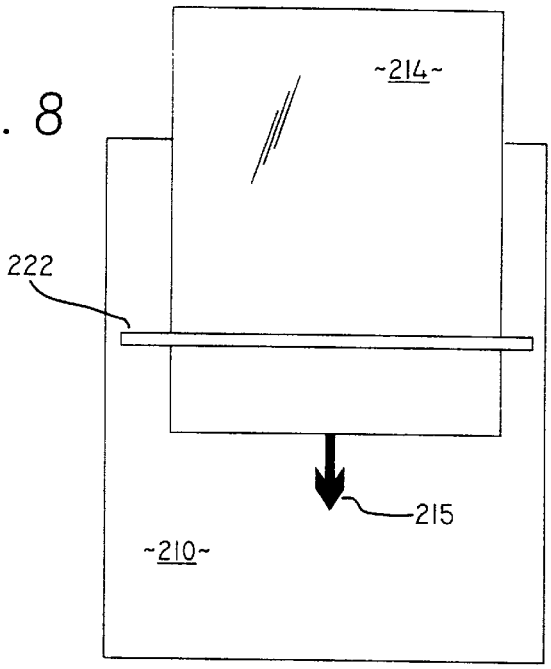
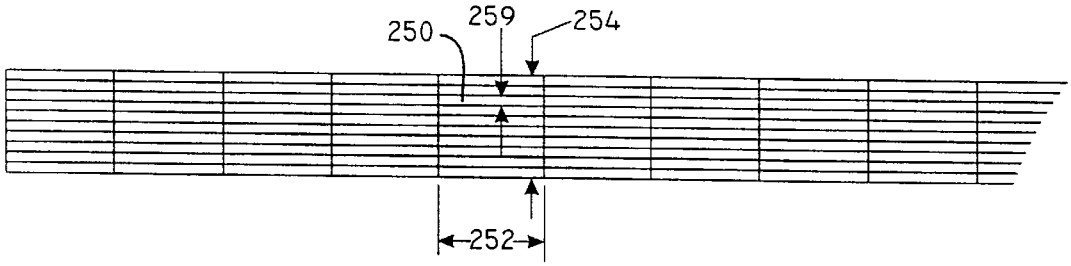
FIG. 9

VERY-HIGH-RATIO MIXED RESOLUTION AND BIPHOD PENS FOR LOW-COST FAST BIDIRECTIONAL ONE-PASS INCREMENTAL PRINTING

RELATED PATENT DOCUMENTS

Closely related and hereby incorporated by reference in their entirety into this document are U.S. Pat. No. 5,541,625 of Holstun et al. and U.S. Pat. No. 5,278,584 to Keefe et al.; and also applications Ser. No. 08/843,492 and 09/183,957, now U.S. Pat. No. 6,236,015 in the names of Akhavain et al.—as well as Ser. No. 09/016,478, now U.S. Pat. No. 6,193,347 and 08/960,927 in the names of Askeland et al.

FIELD OF THE INVENTION

This invention relates generally to machines and procedures for printing text or graphics on printing media such as paper, transparency stock, or other glossy media, by any of the incremental technologies—i.e., from individual ink spots created progressively on a printing medium, in a two-dimensional pixel array—and more particularly to a page-wide or scanning inkjet machine and method that thus construct text or images.

BACKGROUND OF THE INVENTION (a) Early mixed-resolution printing—Print resolution in inkjet printing in the media advance axis is primarily determined by the spacing of the ink orifices, and in normal circumstances the print resolution in the carriage scan axis is the same as in the media advance axis. Classically for example, in the PaintJet and PaintJet XL printers of Hewlett-Packard Company, the print cartridges had a nozzle spacing of 7 to the millimeter (180 nozzles per inch), thereby creating a printing resolution of 7 dots/mm (180 dots per inch, 180 dpi) in the media advance axis, and the print resolution in the carriage scan axis was also 180 dpi. This symmetry made mapping of textual and graphical files, for printing, a relatively straight-forward task.

U.S. Pat. No. 5,541,625 of Holstun et al., however, showed that symmetry was not a necessary constraint—and that asymmetry by factors as high as two could be advantageous. Holstun commented that his invention was "not limited to any particular resolution but can be applied to any addressable pixel grid but can be applied to any addressable pixel grid which increases the resolution in the carriage scan axis."

He then went on, however, to clarify this with the more-specific observation (referring to pixel-per-inch resolution values), "The invention can be used to double the existing resolution (e. g. 360×720; 600×1200) or to provide a less dramatic increase in resolution (e. a., 300×450) . . . " Holstun thus demonstrated that factors between about 1.5 and 2.0 could provide printouts at higher apparent resolution than the cartridge spacing and with little added cost.

At that time, as Holstun pointed out, higher-resolution inkjet printheads were developing with nozzle spacings of 12 to 14 per millimeter (300 and 360 per inch). The demand for higher-quality printing, however, was still not satisfied, and the need existed for improving the overall print resolution without having to further decrease the nozzle spacing on the printhead.

Ordinarily ink spots are inherently circular, or at least roughly so, and this raises the question how two roughly circular spots can be used to fill but not overfill a square area. The Holstun patent makes clear that the ink spots used in his $1/12 \times 1/24$ mm subpixels are distinctly smaller in diameter than the $1/12$ mm height of those subpixels:

> "One characteristic of the invention is the feature of placing adjacent ink droplets on the 300×600 grid such that greater droplet overlap occurs in the carriage scan direction than in the media advance axis. In that regard, it was discovered that when the ink droplets were excessively small, horizontal banding/white space resulted, thus decreasing the print quality."

Thus Holstun seems to warn that the specific embodiments taught in his patent approach a feasibility limit with their 2:1 aspect ratio.

Those skilled in the art may glean, from the various comments excerpted above, that the Holstun invention works at 1.5:1, and perhaps just barely works at 2:1—and that smaller drop diameters leave strips of uncovered white paper. Holding a higher aspect ratio without significant horizontal overfill within a square pixel, however, leads to just such a condition, i. e. smaller drop diameter.

(b) Split-reservoir Pens—The previously mentioned patent to Keefe briefly discusses (column 8, lines 28 through 42, and FIG. 9) the possibility of supplying different sectors of a single pen assembly from corresponding different reservoirs within a pen body—a construction that has been denominated a "biphod" pen. Such reservoirs can be formed simply by provision of a dividing wall within an otherwise single, common reservoir structure.

This sort of construction is advantageous for printing at least two ink colors from a single pen. In Keefe the two or more reservoirs feed nozzles formed in different parts of a single, common pen head that is formed by a tape automated bonding (TAB) assembly.

This construction is also known as a TAB head assembly or THA. Important refinements in THA construction are introduced in the Akhavain patent documents mentioned above.

Such an assembly includes internal ink-supply channels and heaters integrally formed in a unitary silicon die, and a polymeric tape bonded to the die. The tape has laser-drilled holes to form the pen nozzles, and electrically conducting traces for interconnecting the heaters with control circuitry elsewhere in the printer.

Pen bodies subdivided in this way are available in routine production, as they have been designed for use in such printers as the Hewlett Packard Model 2000C. The Keefe geometry relies upon a THA with edgewise feed of the ink to the THA—exploiting that feature to achieve a split ink supply with no need for additional complexity of internal channels through central portions of the die.

(c) Prior "staggered"-pen construction—Before introduction of the extremely economical THA, pen nozzle arrays typically were fabricated by drilling nozzle apertures through thin metal plates. In some of those earlier configurations, although plural pen bodies were mutually aligned the individual colors were sometimes staggered.

(d) Present design challenaes—One interesting characteristic of printer-performance criteria is the divergent requirements for images (i. e. pictorial matter such as photographs, paintings and the like) as distinguished from text. With continuing improvement of printer performance and continuing decrease of prices, it becomes more important to design printers that deliver, in combination:

high image quality, high quality of text even on plain paper, high throughput of text on plain paper, and low cost.

These considerations will be taken up in turn.

High image Quality requires low drop volumes, to reduce the visibility of individual dots on the printing medium. Past inkjet black pens have had drop volumes in the range of 30 to 150 pL. Future black drop volumes will have to be 16 pL or lower to provide high image quality on plain paper.

High text quality on plain paper has been achieved by increasing resolution and maintaining high edge acuity. Previous approaches have led to 24×24 dots/mm (600×600 dpi) text. High-quality dark text with conventional inkjet inks requires a drop volume of approximately 120 pL per square pixel of 1/12 mm (1/300 inch) on a side—in other words, per pixel in a grid of 12×12 dots/mm (300×300 dpi).

Highest text throughput is achieved by using single-pass bidirectional printing. At the same time it is necessary to maintain high quality of text appearance, and in single-pass printing this requires that vertically adjacent lines of inkdrops of common color merge.

To accomplish this, the printer must fire the vertically adjacent drops at essentially the same time. In addition—as noted later in this document—the absorptive properties of the printing medium must facilitate such coalescence; fortunately plain paper generally does so.

The previously mentioned copending '927 application of the present inventor and coworker takes up numerous aspects of the multidrop-coalescence problem, particularly from the perspective of single-pass printing as a goal. The '478 application also noted above also introduces several important considerations of multidrop, single-pass printing—but rather from the perspective of hybrid use of that general printing mode—in combination with multipass printing.

Low cost is difficult to achieve for fast, single-pass high-resolution printing. In systems with symmetrical text resolution, a costly, tall, high-density-nozzle-pitch printhead is required.

One way to reduce costs is to use asymmetric text resolution—it is less expensive to fire more drops at higher resolution in the scan axis and use lower resolution (lower-density nozzle spacing) in the paper axis. One example of this approach is taught in the above-mentioned Holstun patent which teaches printing text at 24×12 dots/mm (600×300 dpi) to achieve high text quality with a nozzle pitch of 12 dots/mm (300 dpi).

The prior art, however, offers no system capable of implementing such specifications.

(e) Conclusion—Absence of such capability continues to impede achievement of uniformly excellent inkjet printing—at high throughput on all industrially important printing media and in particular even on plain paper. Thus important aspects of the technology used in the field of the invention remain amenable to useful refinement.

SUMMARY OF THE DISCLOSURE

The present invention introduces such refinement. Before offering a relatively rigorous description or definition of the invention, the paragraphs below provide an informal introduction that maybe helpful to the reader and should not be considered a statement of the invention.

When the four above-introduced requirements are considered in combination, we see them recouched as a set of desired specifications for a printing system that can deliver this combination of characteristics:

black drop volumes of 16 pL or less, for high-quality images;

black ink density of 120 pL or more per pixel in a grid of 12×12 dot/mm (300×300 dpi), in a single pass, for dark text;

nozzle pitch of 12 dots/mm (300 dpi), for low cost; and high-quality text.

These conditions are seemingly incompatible, since provision of 16 pL black drops—with 120 pL/pixel area fill—call for 120/16=7½ or roughly eight drops per pixel. These drops must be deposited in a line extending horizontally across the pixel.

In other words the aspect ratio of the ink-drop array is not even close to the two-to-one value that appears, from the above-discussed Holstun patent, to be a limiting case of feasibility. Rather it is eight to one, a much larger aspect ratio.

Based on the teachings in that patent, it is easy to predict the appearance resulting from deposition of such tiny inkdrops. They would be expected to leave perhaps three-quarters of the pixel height unfilled, and thereby would yield extremely conspicuous tall bands of unpainted white space between thin, or shallow, lines of ink.

It is also easy to predict that any effort to make such a system work well would entail drastic restructuring of key components in the printing system. For example, it will be readily appreciated by those skilled in the art that special, extraordinary engineering and design work must be required in reconfiguring the THA (tab head assembly) used to create each nozzle array, as well as the heater array behind the THA, to somehow coax eight 16 pL drops to fill a square pixel without wholly unacceptable white banding.

In work leading to the present invention, however, it was very surprising to find that such predictions were entirely mistaken. In fact, very much to the contrary of the expectations, ink coverage turned out to be actually as regular and as well defined as in more-conventional systems.

Hence a key feature of the present invention is use of extremely high aspect ratios in inkdrop deposition patterns ratios in fact exceeding 4:1 and preferably 8:1.

Furthermore it has been found that if desired such operation can be provided with a minimum in redesign of the touchiest componentry, and indeed that a completely standard THA can be used!

The heater array, too, is substantially conventional. All that is required is straightforward modification of the ink-reservoir chambers and equally straightforward modification of the firing signals.

Surprisingly enough, an entirely satisfactory reservoir reconfiguration actually can be accomplished by adapting pen bodies that are standard in other products. Firing parameters are easily adapted through small revisions to software.

Thus the present invention radically extends the Holstun teachings, further improving overall print resolution by a very large increase of print resolution in the carriage scan axis. It provides a very greatly further-improved thermal inkjet printhead that delivers ink in even smaller drop volumes than before, and which operates at reduced firing-energy levels.

Like Holstun's, the present invention also provides addressable high-resolution pixels which are capable of being printed in a single pass of the print cartridge. It also provides printing resolution in the carriage scan axis which is far higher than the printing resolution in the media advance axis, while minimizing the amount of ink applied to the printing media.

The invention accordingly contemplates an ink cartridge which fires smaller drops of ink onto various types of media—such that eight droplets can be fired onto each square pixel area, in a single pass from the same cartridge, to substantially fill the square pixel area. In a preferred embodiment of the invention, addressable print resolution of 96 dots/mm (2400 dpi) is achieved in the carriage scan axis, with resolution of 12 dots/mm (300 dpi) in the media advance axis.

All this is accomplished without having to employ any dot-depletion algorithms. In that regard, previous high-density printing systems have typically required the use of such algorithms.

Now with the foregoing orientation in mind, the following is a more-formal discussion of the invention. In its preferred embodiments, the present invention has several aspects or facets that can be used independently, although they are preferably employed together to optimize their benefits.

In preferred embodiments of a first of its facets or aspects, the invention is incremental-printing apparatus. It includes some means for establishing a pixel grid having a ratio of pixel height to pixel width of at least four.

For purposes of generality and breadth in discussing the invention, these means will be called simply the "establishing means". The apparatus also includes some means for addressing marks of a single particular ink type to all pixels of the grid—and again for breadth and generality these means will be called the "addressing means".

As is well known in the field of incremental printing a great number of equivalent "means" for establishing a pixel grid, and addressing marks, are available. These include the entire technologies of dot-matrix (i. e. mechanical-pin), inkjet, bubblejet, hot-wax transfer, xerographic (i. e. laser) and other methods now known or later to be developed, operating on the same general principles. All these technologies, and others, and their equivalents, are within the scope of the above-mentioned means.

Such technologies nowadays usually include digital electronic processors, as parts of both the establishing and addressing means. These may be in the printer, or may reside in general-purpose computers, operating so-called "printer drivers"—or may be in separate image-processor units connected between a computer and a printer to relieve the computer for other tasks while providing extremely fast processing.

In any event the establishing and addressing functions may take the form of software such as a printer driver, or a graphics application or a word-processing application; or may take the form of firmware read from a read-only memory (ROM, EPRCM, EEPROM etc.) into a general-purpose processor; or may take the form of processing instructions hard-coded into an application-specific integrated circuit (ASIC). In the future expectably all such functions may be shifted into functionally equivalent hardware and program forms including but not limited to digital optical processors, analog processors, biological processors, etc. All these program and hardware forms, and others, and their equivalents, are within the scope of the above-mentioned means.

The foregoing may represent a description or definition of the first aspect or facet of the invention in its broadest or most general form. Even as couched in these broad terms, however, it can be seen that this facet of the invention importantly advances the art.

In particular, it has been found that such highly asymmetrical pixel structures enable a single printer system to satisfy all four of the criteria introduced above First, the very narrow pixels (or as they will be sometimes called in this document "subpixels") and the corresponding very small inkdrops or other marks preserve the capability of the system to create very finely resolved images.

At the same time they enable extremely fast single-pass bidirectional output for text, with quality substantially equal to that possible with a square-pixel grid at 24 pixels/mm. Furthermore, in inkjet implementations, as will be seen these features dovetail remarkably well with a novel use of single tab-head assembly (THA) nozzle arrays to fire plural colors, thereby leading to outstanding economies.

Although the first major aspect of the invention thus significantly advances the art, nevertheless to optimize enjoyment of its benefits preferably the invention is practiced in conjunction with certain additional features or characteristics. In particular, preferably the asymmetry ratio is at least six; and ideally it is eight or more.

It will be understood that as a practical matter the benefits of the invention accrue progressively with increase of asymmetry ratio from roughly two to roughly eight. Hence the numbers just mentioned are not to be regarded as rigid quantitations but rather as qualitative demarcations along the spectrum of beneficial improvement.

It is also preferred that the apparatus include a marking array, and ordinarily some means for providing substantially continuous relative motion between the marking array and the printing medium. Preferably a smaller of the two orthogonal pixel dimensions is along the relative-motion direction.

Thus if the marking array is or includes a page-wide type of marking array, then the two orthogonal pixel dimensions are pixel width and pixel height, respectively. In this case, preferably the relative-motion direction is substantially vertical with respect to the finished image. This is so whether the the relative-motion providing means advance the printing medium under the page-wide marking array, or conversely advance the array (as for instance on a gantry) over the printing medium.

If the marking array instead is or includes a laterally scanning printhead, then the two orthogonal pixel dimensions are reversed—i.e. they are pixel height and pixel width, respectively. In any event, for fullest advantage of the first independent aspect of the invention the relative-motion providing means provide—with respect to each portion of the printing medium—exactly one pass of the relative motion.

Another preference is that the establishing means include (1) at least one array of marking elements, these elements being spaced apart along a media advance axis by a first distance, and (2) means for displacing the array of marking elements along a scan axis. In this case, the ratio is equal to the first distance divided by the second, and the addressing means include means for—concurrently with operation of the displacing means—operating the marking elements to apply the colorant when the marking elements are at positions spaced apart along the scan axis by a second distance.

(The marking elements most highly preferred are inkjet or bubblejet nozzles—whether thermal or piezoelectric, on-demand or continuous. Nevertheless the invention is believed to be advantageous for hot-wax transfer systems, and for some purposes xerographic systems, and also for other incremental-printing technologies to which the principles of the invention are applicable.)

Another preference is that the array of marking elements include plural subarrays of marking elements for each of plural colorant types, respectively. In this case it is further preferable that—more specifically—the at least one array of marking elements include plural arrays of marking elements for each of plural colorants respectively; and also that at least one of the arrays in turn include plural subarrays of marking elements for each of plural colorant dilutions respectively.

Yet another preference is that the "at least one" array include an inkjet printhead—or part of an inkjet printhead—and that each of the marking elements include (defined in the printhead) an inkjet nozzle and means for ejecting ink from the nozzle. Still another preference is that the at least one array include an inkjet pen; that the pen include a single tab-head assembly (THA) defining nozzles for firing ink of plural types; and that the pen further include plural ink-supply means for supplying the ink of plural types to plural groups, respectively, of the nozzles.

As to this last innovative use of THA technology, it is further preferable that the one THA define the nozzles in plural staggered parallel columns of nozzles. In this case system preferably includes plural ink-supply means for supplying said ink of plural types to the plural staggered columns respectively.

In this document the word "staggered" is used in a specific sense. It means that the two sets of nozzles in the plural parallel columns of each pen are not along common horizontal lines—but instead occupy alternating vertical positions, as will be plain from the accompanying diagrams and later detailed discussion. Thus in this document the term exclusively refers to a mechanically, aeometrically "staggered" characteristic of the hardware (nozzles).

This sense is entirely different from the sense which is sometimes employed in discussing the time-"staggered" firing of pens. Such firing produces an intentional, very small, horizontal geometrical misalignment of dots addressed to pixels that nominally are aligned in vertical pixel columns. This technique is used to avoid electrical overload that would result from attempting to fire all resistors simultaneously.

In preferred embodiments of its second major independent facet or aspect, the invention is an incremental-printing method. It is for use with an array of marking elements that are spaced apart along a media advance axis by a first distance.

The method includes the step of, for colorant of a particular color, displacing the array of marking elements along a scan axis. It also includes the step of, concurrently with the displacing step, operating the marking elements to apply the colorant.

More specifically, the operating step induces the elements to apply colorant when the marking elements are at positions spaced apart along the scan axis by a second distance. The first distance is at least four times the second distance.

The foregoing may represent a description or definition of the second aspect or facet of the invention in its broadest or most general form. Even as couched in these broad terms, however, it can be seen that this facet of the invention importantly advances the art.

In particular, the benefits of this asymmetrical-marking-position method form of the invention are closely related to the asymmetrical-pixel-structure form of the invention—introduced above as the first facet. Even though the second major aspect of the invention thus significantly advances the art, nevertheless to optimize enjoyment of its benefits preferably the invention is practiced in conjunction with certain additional features or characteristics. In particular, the preferences discussed above for the first facet are applicable here as well.

In preferred embodiments of its third major independent facet or aspect, the invention is an incremental-printing apparatus. It includes at least one single tab-head assembly defining nozzles for firing ink of plural types. It also includes at least one inkjet pen body, which in turn includes plural ink-supply means connected to supply the ink of plural types to plural groups, respectively, of the nozzles.

This aspect of the invention also includes some means for conducting ink from the plural ink-supply means to the plural groups of the nozzles, respectively. These means are defined within the tab-head assembly die, and they conduct ink along channels that are substantially centrally defined through the die.

The foregoing may represent a description or definition of the third aspect or facet of the invention in its broadest or most general form. Even as couched in these broad terms, however, it can be seen that this facet of the invention importantly advances the art.

In particular, this facet of the invention goes very specifically to the remarkable economies that are facilitated by the first two, asymmetrical-pixel, aspects of the invention. This third aspect of the invention, however, is by no means limited to such imaging-technology characteristics, but rather has applicability in symmetrical-pixel environments as well.

Although the third major aspect of the invention thus significantly advances the art, nevertheless to optimize enjoyment of its benefits preferably the invention is practiced in conjunction with certain additional features or characteristics. In particular, preferably the at least one single tab-head assembly defines the nozzles in plural staggered parallel columns of nozzles; and the plural ink-supply means supply said ink of plural types to the plural staggered columns respectively.

It must be understood, however, that this is not a requirement. The invention encompasses ink supply to plural columns in which the nozzles are not staggered but rather aligned side-by-side—or in which the nozzle sets fed with different ink colors are aligned end-to-end, or are offset in many ways.

Another preference is that the "at least one" pen body actually include at least two pen bodies—for discharging ink of, respectively, at least two pluralities of ink types. In this case preferably the at least one pen body includes at least four pen bodies for discharging ink of, respectively, at least four pluralities of ink types.

Still with regard to the same four-or-more-pen preference, it is further preferable that the at least four pluralities of ink types include inks of at least two different colors, and plural dilutions of at least one ink of a particular color. Yet another preference is that the plural ink-supply means be either:

plural ink-storage chambers within each pen body; or plural ink-conveyance tubes extending from within each pen body to receive ink from plural external ink sources, respectively.

Yet other possible preferences, as for example relating to the specifics of the ink colors employed in the various pens respectively, and the possible exchanging of inks and orientations in biphod pens, will be evident to those skilled in this field. Some such significant variations are discussed below.

All of the foregoing operational principles and advantages of the present invention will be more fully appreciated upon consideration of the following detailed description, with reference to the appended drawings, of which:

BRIEF DESCRIPTION OF THE DRAWINGS

FIG. 1 is a perspective view of an exemplary color inkjet printer which may incorporate the features of the present invention;

FIG. 2 is a like close-up view of the carriage used in the printer of FIG. 1, showing two print cartridges each having two inks of different color or type, and also showing two optional bays for two additional print cartridges with inks of the same colors but different dilution;

FIG. 8 is a highly schematic diagram showing an alternative to the scanning-pen printer mechanism of FIG. 2, namely a page-wide inkjet or like marking array that prints an entire horizontal line at a time while the print medium is vertically advanced—continuously or nearly continuously;

FIG. 9 is a diagram analogous to FIG. 4 and to the right end of FIG. 3 but showing a pixel grid such as is preferred for the page-wide system of FIG. 8, and particularly a grid with ten wide, shallow subpixels in each square pixel.

DETAILED DESCRIPTION OF THE PREFERRED EMBODIMENTS

1. SYSTEM HARDWARE

Figure 3:
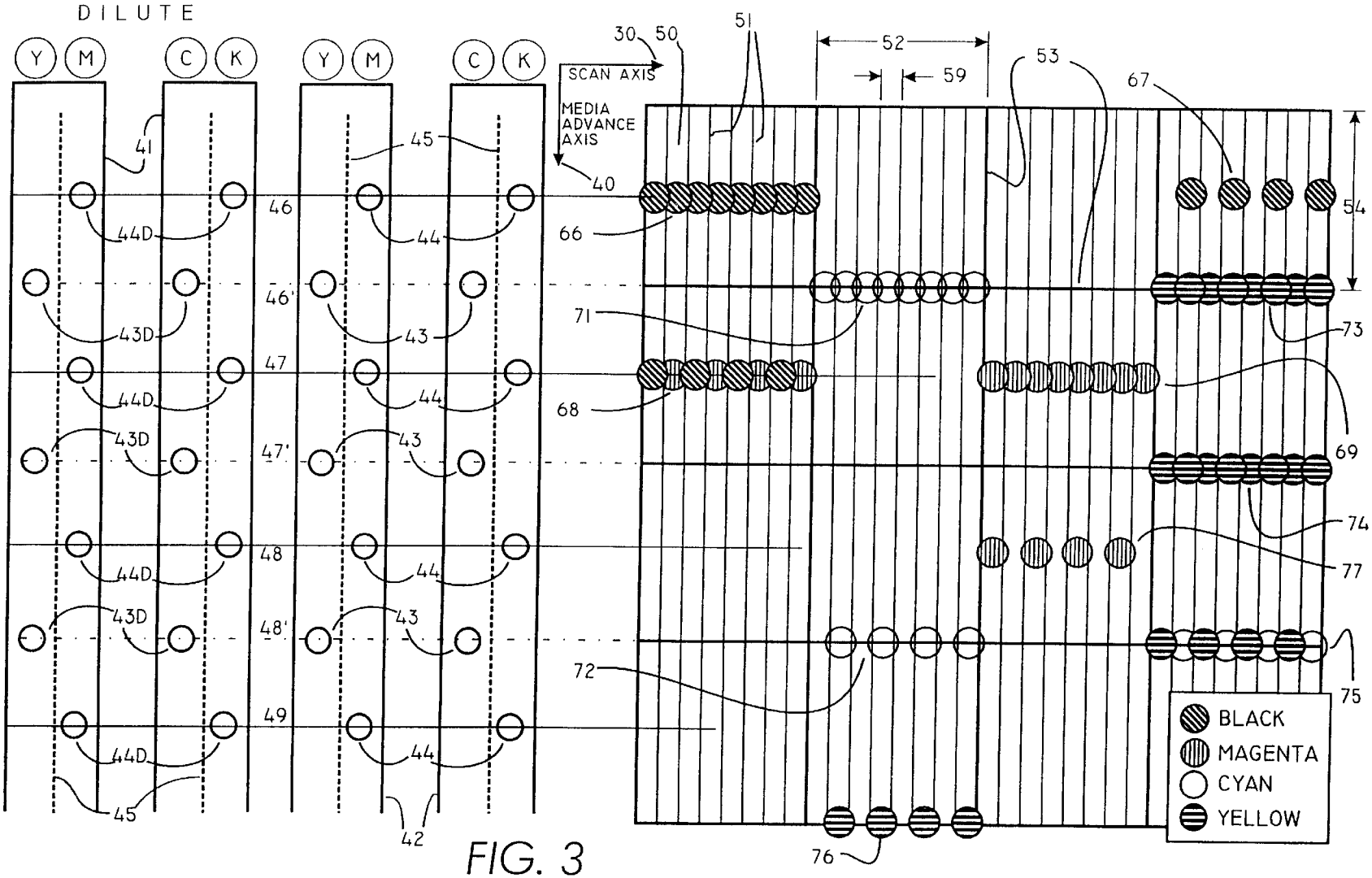
FIG. 3 is a very highly schematic drawing showing end portions of nozzle arrays for four such print cartridges, in conjunction with a corresponding portion of a pixel grid, such as can be used to fire small ink droplets (in various exemplary illustrated patterns) onto a 300×2400-dot-per-inch addressable grid or other grid with 1:8 resolution ratio.

Although the invention can be used in any printing environment where liquid (including meltable solid) ink is applied to media by a swath printer, the presently preferred embodiments of the invention are used in an inkjet printer of the type shown in FIGS. 1 and 2. In particular, inkjet printer 10 includes an input tray 12 containing sheets of media 14 which pass through a print zone, and are slowly fed past an exit 18 into an output tray 16.

Referring to FIGS. 1 and 2, a movable carriage 20 has four bays for holding print cartridges or "pens". Two of the bays 22, 24 are shown empty, and two pens 26, 28 are shown installed in the other two bays. Details of the pens and their mounting arrangements are discussed (subsection 3 below) following introduction of the novel pixel structure of the present invention.

The front of the carriage has a support bumper 30 which rides along a guide 32. The back of the carriage has multiple bushings such as 34 which ride along a slide rod 36.

The position and speed of the carriage as it traverses the media to left and right are determined from an encoder strip 38. This information enables selective firing of the various ink nozzles on each print cartridge at the appropriate times during each carriage scan.

2. RESOLUTION RELATIONSHIPS

Details of the unique pixel arrangement and ink droplet distribution are best shown in FIG. 3. Although the resolution that is achieved in the illustrated embodiment is 12×96 dots/mm (300×2400 dpi), based on a grid having subpixels of 1/12 by 1/96 mm (1/300 by 1/2400 inch), the invention is not limited to any specific resolution.

Rather, the invention is particularly focused upon any addressable pixel grid which increases the resolution in the carriage scan axis to a radical extent in comparison with prior teachings. More specifically the invention preferably provides resolution in the scan axis that is roughly eight times that in the media advance axis. A significant portion of the benefit conferred by the present invention, however, is obtained with a lower asymmetry ratio such as roughly four, all within the spirit and scope of the invention.

Inking is applied across each square pixel in a highly anisotropic horizontal linear pattern—which is strongly mismatched to the square shape of the pixel. Therefore the invention relies upon a calculated spreading of the ink in both directions vertically from each linear pattern, so that the ink in each line merges with ink in the lines above and below.

This phenomenon is particularly important when writing in ink of a single color—as for example is usually the case for text. Since it is vertical coalescence of the inking which produces merging, it is important that this coalescence process be adequately advanced before passage of the time required for the ink to soak into the page. Some additional inking strategy to provide sharp text edges is described later in this document; and again the previously cross-referenced '927 and '478 applications are relevant to this part of the technology.

As shown in FIG. 3, in the direction of the media advance axis 40 each color C, M, Y, K in each print cartridge 41, 45 is assigned to an array of nozzles 43, 43D, 44, 44D that are respectively 1/12 mm (1/300 inch) apart. For the sake of clarity the drawing shows only the topmost three or four nozzles for each color—out of a total nozzle count of one hundred fifty or more, for each color.

Thus for black "K" and magenta "M"—and for dilute black "K" and magenta "M" as well—the center of each nozzle respectively defines the horizontal centerlines 46–49 for each pixel with respect to the media advance axis. The use of ink of different dilutions to provide finer control of subtle color gradations is well known in the art, and is suggested here by the denomination "DILUTE" above the ink-color markings in FIGS. 1 through 3.

The magenta M and black K nozzles, as seen in the left-hand half of the drawing, are at common heights. Thus for magenta ink M and black ink K the fundamental vertical pixel height 54 straddles the topmost centerline 46, and analogously (though not marked explicitly) for the lower centerlines 47–49.

Similarly for yellow "Y" and cyan "C"—and also for dilute yellow "Y" and cyan "C"—the center of each nozzle respectively defines the centerlines 46'–49' for each pixel relative to the media advance axis. These centerlines, however, are aligned with the horizontal boundaries, rather than the centers, of the pixels/subpixels. (The horizontal and vertical boundaries 53 of the pixels are drawn in bold lines, exhibiting clearly the square profile of each pixel—i.e., the pixel widths 52 and heights 54 are equal.)

Thus in effect the yellow Y and cyan C pixel structure is vertically offset by a half pixel relative to the magenta M and black K pixel structure. For simplicity of FIG. 3, however, the pixel structure illustrated in the right-hand portion of the drawing is drawn explicitly for the black and magenta nozzles 44, 44D only.

In contrast to this pixel structure as seen for the media advance axis, with respect to the carriage scan axis 30 the width 59 of each subpixel 50—that is, the distance between its opposing vertical boundaries 51—is 1/96 mm (1/2400 inch). Thus the invention provides a nonsymmetrical subpixel which is only one-eighth as wide in one direction, the scan-axis direction 30, as it is in the other direction—the media-axis direction 40.

One full pixel, delineated by boundaries 53 as noted above, thus provides eight narrow, tall subpixels 50. Each subpixel 50 is delineated in the drawings by subpixel vertical boundaries 51, considered in combination with the horizontal top and bottom boundaries of the full pixel.

Figure 4:
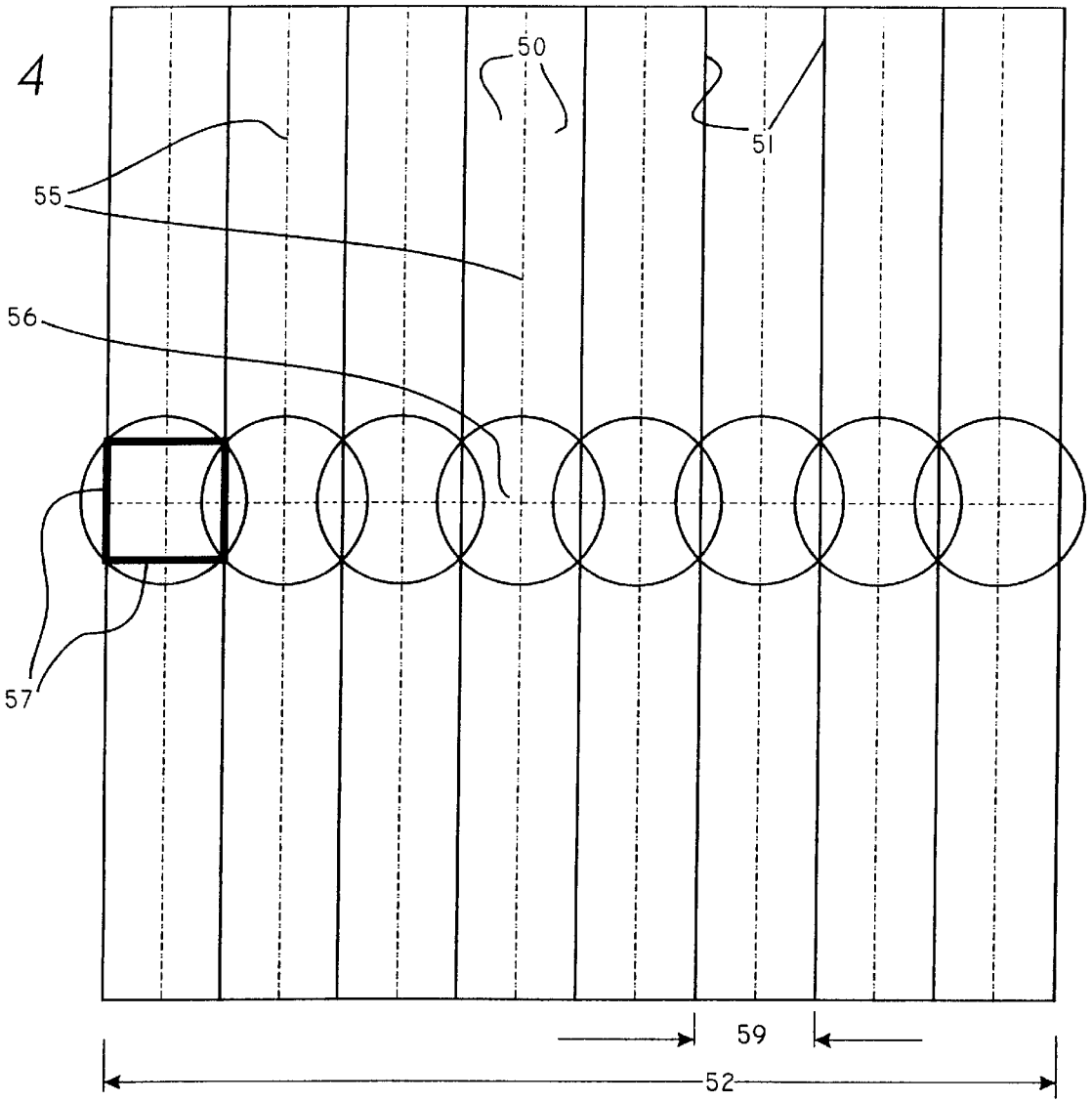
FIG. 4 is a drawing like the pixel-grid portion of FIG. 3 but greatly enlarged to show a single square pixel with its eight thin, tall subpixels.

Each subpixel also has vertical and horizontal centerlines 55, 56 (FIG. 4). The black and magenta inkdrops are nominally addressed to or centered upon the intersections of these centerlines 55, 56 as shown.

More specifically the nominal diameter of each drop if considered alone, without regard to coalescence or vertical spreading, equals the diagonal of a square 57 constructed within a single subpixel. In other words, such a square 57 is inscribed within the circle nominally formed by each drop.

Inkdrop size is of critical importance to the present invention, and must be as small as possible and yet large enough that the liquid volume of eight drops is sufficient to completely fill a full pixel i. e., the larger square that is 1/12 mm (1/300 inch) on a side. In this way the use of small drops, on a grid of subpixels each measuring only 1/12×1/96 mm (1/300×1/2400 inch), provides improved clarity in graphic illustrations as compared to conventional resolution provided by prior-art swath printers using liquid ink.

In that regard, the droplet size for a normal grid of 12 dots/mm (300 dpi) in a previous DeskJet inkjet printer of Hewlett-Packard was approximately 135 to 140 pL, and the comparable drop volume for an improved printer/cartridge system according to the Holstun patent was approximately 77 pL. The black-ink drop volume in accordance with the present invention is only 16 pL—and it will be noted that eight such drops aggregate to 128 pL, thus providing colorant volume and potentially color saturation comparable to inking in the DeskJet.

Thus the present invention, through use of an implausibly extreme but nevertheless operational asymmetry ratio achieves all four of the objectives enumerated earlier, and remarkably does so without creating extreme problems of paper cockle, color bleed, long drying time, and the like that are typically associated with excessive ink on the media (e. g. high density graphics, area fills, etc.).

One characteristic of the invention is the feature of placing adjacent ink droplets on the grid of 12×96 dots/mm such that considerable droplet overlap occurs in the carriage scan direction—but in the first instance, as the drawings make clear, none in the media advance axis. It was reported by Holstun that when ink droplets were excessively small, horizontal banding or white space resulted, thus degrading print quality; but in practice of the present invention very remarkably no such problem has materialized.

According to the present invention very great versatility is obtained in the ways of mixing colors and presenting pure colors. A series of black drops 66 extending across and filling each of the eight subpixels in a pixel produces a black pixel, when the ink in the eight pixels—already overlapping as seen in FIGS. 3 and 4—spreads vertically toward the upper and lower pixel boundaries.

A middle gray can be obtained by inking alternate subpixels 67 (considered alone) across a full pixel, and other grays are produced by differing ratios of inked black subpixels with unlinked subpixels. As will now be very evident to those skilled in the art, a great variety of subpixel inking patterns and strategies is available to produce any desired one of myriad specific gray levels.

Thereby, before dithering at the 1/12 mm grid hierarchy and without resort to dilute inks, twice as many monotone levels can be produced within a 1/12 mm square pixel by the present system (thanks to its smaller drop size) as by the best prior-art alternative of 1/24 mm symmetrical pixels. Thus the number of levels from white through black is eight for the present system, and only four in the prior art.

Another advantage is that color text too can be high quality. Color inks generally are made to spread more than black, and must be suitable for use in making secondaries; these properties can be exploited by inking strategies to provide high-quality text.

Color inking of primaries (cyan, magenta and yellow) is generally 35 to 40 pL per square pixel, produced in the present invention by eight small drops—each somewhat under 5 pL per subpixel. Accordingly the amount of inking for each secondary (red, green and blue) is roughly 70 pL or more.

Although the primary benefits of the present invention relate to spatial resolution and economy, rather than calorimetric subtlety, the above-discussed added versatility can be brought to bear in the color regime also. This versatility can be exploited to provide either extraordinarily fine color gradations very quickly, within an extremely economical printer, or color gradations of the highest quality in a more expensive platform that is capable of full dithering and plural ink dilutions.

A variety of intermediate ways to make use of this capability will now be apparent to those skilled in the art. Furthermore, it is not necessary to make the number of available dilutions the same for all ink colors, in a particular printer. For instance it may be preferred to have three shades of magenta but only one of yellow.

Similarly magenta drops 69 alone can be used to fill a pixel, so as to produce a pure magenta-colored pixel; or a series of magenta drops 77 can be spaced apart at various inked-to-uninked subpixel ratios to provide a magenta wash of more finely controllable saturation than intrinsic in prior-art pixel structures, i. e. apart from dithering and dilution. An alternating series 68 of magenta and black pixels, on the other hand, produces a magenta shade and both white and black may be mixed with magenta to obtain a wash with undercolor removal to black—yet again more finely graduated than intrinsically possible heretofore.

Analogously a series of uninterrupted cyan drops 71 yields a pure cyan pixel; or a series of spaced-apart cyan drops 72 produces a cyan wash. As shown for the magenta case, cyan and black can be intermixed for a single major pixel to provide a great number of cyan shades (not shown) as will be well understood in the art.

Since cyan and black—in the illustrated system—can never be inked at the same vertical positions in the grid, however, such mixing is instead provided through patterns 67, 73 employing a somewhat more remote configuration for adjacency. While this may appear cumbersome, in some circumstances it can also be beneficial in that the number of ratios for such combinations ranges in principle from 1:8 through 8:1, rather than only 1:7 through 7:1.

(It should be kept in mind that the illustrated system of staggered columns is not the only possibility, although it is favored because it uses a stock THA employed in other printers for 24 dot/mm resolution. An alternative is to provide a special THA with in-line columns.) Furthermore, again for the illustrated system, cyan can be mixed with yellow in an equal alternating series 75 to create green—or in other proportions to provide shades of green ranging across a gamut span from slightly greenish yellow (1:7 cyan:yellow) to slightly greenish cyan (7:1 cyan:yellow). Similarly yellow pixels alone 74, or spaced-apart yellow pixels 76, can be used to provide yellow fields or a finely graduated gamut of yellow washes, and yellow can be mixed with magenta (in the manner suggested at 67, 73 for magenta and black).

The resulting lavenders, reds, pinks etc. are more finely graduated than available in the prior art before dithering and without dilutions. Intrinsically more subtle cyan-and-magenta gradations too—purples, blues and aquas—are possible here than in the prior art.

As noted above, resolution is 12 dots/mm for ink of any single color, or for any two inks in the groups that share nozzle positions relative to the media axis. That is, resolution is 12 dots/mm for magenta and black, whether printed alone or together, since their nozzles 44 are adjacent along respective centerlines 46–49. Similarly resolution is 12 dots/mm for yellow and cyan, whether printed alone or together, since their nozzles 43 are adjacent along respective centerlines 46'–49'.

In a sense, however, the overall resolution of the image is potentially 24 dots/mm, taking into account ink of all colors—that is to say, some ink is positioned along the media axis at spacing of 1/24 mm. This effect is actually present only if at least one ink in each of those two groups is actually in use.

The advantage of the Holstun invention in balancing the inking of secondary versus primary colors is retained here. That is, the same number of inkdrops can be used for both secondaries and primaries. Actually that benefit can be extended somewhat, because finer graduations are possible.

For instance, it is possible to make pure magenta with eight subpixel-size inkdrops, but to make red with seven such drops, or with nine—e. g., three magenta and four yellow, or four and five. The improvement in color balance may be worthwhile even though such a small imbalance in liquid loading may be relatively insignificant, not at all as severe as the double inking required for secondaries noted by Holstun.

Also enhanced in the present invention are the previously reported benefits of print quality around the edges of the image, lower-energy circuitry and smaller firing resistors. The present invention provides very fast text printing through use of a bidirectional single-pass mode, as noted initially—and yet this mode produces excellent text quality. A same-frequency/faster-speed mode such as used by Holstun is possible too, though the high-quality mode is very fast.

Particularly striking in the present invention is its capability to produce excellent text quality with pens and pixel grid of only 12 dots/mm. That capacity is exploited in a particularly economical and novel way by using a nozzle plate in the form of a now-conventional tape-automated-bonding head assembly (THA) with twenty-four nozzles per millimeter.

Such a THA is fortuitously available in the form of two parallel columns of nozzles, each column having only twelve nozzles per millimeter as shown in FIG. 3. This approach is detailed below.

3. PRINTHEAD CONFIGURATION

One implementation of the present invention uses biphod pens 26, 28 (FIGS. 1 and 2)—i. e., pens that have a pair of distinct separate ink reservoirs separated by a dividing wall 45 (FIG. 3) but feeding a common THA assembly 42. As noted earlier, such pen bodies are available in routine production for Hewlett Packard printers.

To render such a system practical, it is necessary to replicate the backpressure-control regulator that conventionally serves a single reservoir chamber holding a single ink color. Since available space available within a pen body is very limited, a new, miniaturized regulator design is required.

Furthermore such a biphod pen can be fitted with a THA assembly that provides twenty-four nozzles per millimeter (six hundred per inch) in two staggered columns e. g. columns Y and M (FIG. 3) or columns C and K. The two columns—advantageously about 2½ mm (0.1 inch) apart—can be fed from the two reservoirs, respectively, of the biphod pen body.

Such a THA assembly is conventional and now available in routine production, though in actual practice heretofore used for just a single, common ink. Thus in conventional use this type of THA assembly provides one ink at a natural resolution of twenty-four dots per millimeter.

According to the present invention, however, this assembly thereby provides—in each pen THA 42—two nozzle columns 43, 44 respectively firing two different ink types Y, M or C, K. In other words, each pen provides two inks, each ink at a natural resolution of twelve dots per millimeter as in FIG. 3.

As will be clear, two such pen bodies 26, 28 (FIGS. 1 and 2) on a carriage 20 together provide an extremely low-cost four-ink printing system—which is advantageous in several ways. Having fewer nozzles than a conventional four-pen-body system, it requires fewer electrical driving components, and also fewer traces on the trailing cable between the carriage and fixed electronic boards.

This system also prints faster, since it requires less carriage overtravel—and because it is less massive is also more economical in terms of electrical power and weight of motors, and motor drive electronics. In addition the pen service station and the overall printer case can be smaller, each fractional size decrease representing significant overall economies in material cost, inventorying and shipment. For photographic-quality printing, two different dilutions can be used for each ink color.

Such a system has been modeled using just one column of an existing 600-nozzle 16 pL/drop pen, in a substantially standard prototype printer that was otherwise standard and compatible with the pen. Even the ink used in the modeling was standard—namely, Zaphod Zap 6 black.

Figure 5:
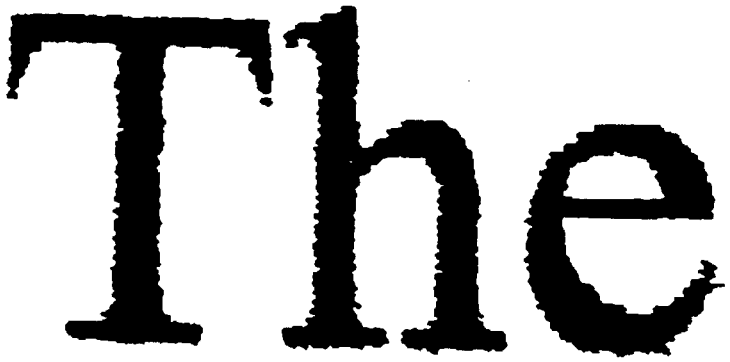
FIGS. 5 through 7 are photomicrographs of specimen printouts comparing the quality of text printout using the present asymmetrical-pixel invention (FIG. 5) against two conventional symmetrical-pixel (namely 1/24 mm square) printouts; .

A TrueType® font was first rendered at 96×96 dots/mm (2400×2400 dpi) and then manually pruned to provide a file of 96×12 dots/mm (2400×300 dpi). The resulting text plot (FIG. 5) was printed at 25 cm (10 inches) per second, 24 kHz—as compared with the 8 kHz firing rate mentioned in the Holstun patent.

Figure 6:
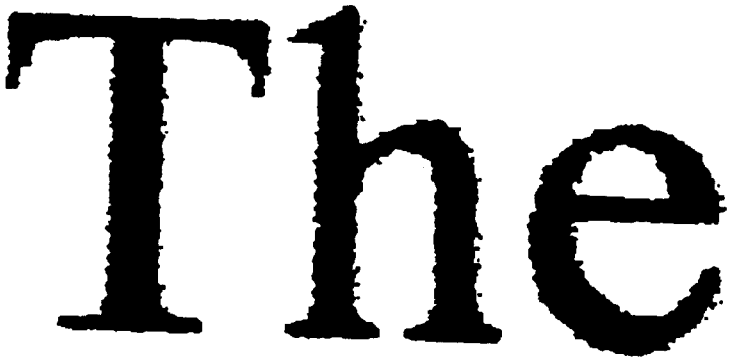
Figure 7:
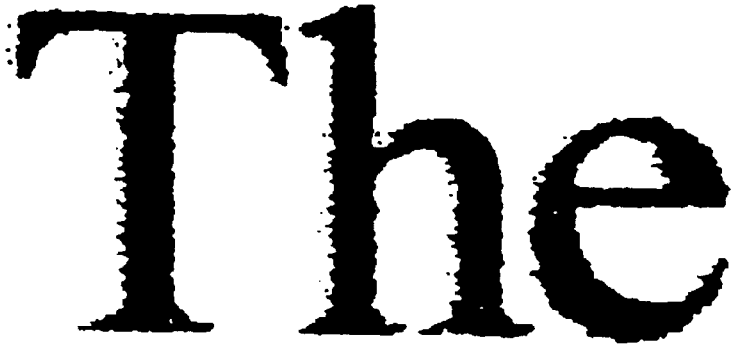

For comparison the same text was printed using standard pens at 24×24 dots/mm (600×600 dpi) in two other Hewlett Packard printers: a DeskJet 720 (FIG. 6) and a Deskjet 1600C (FIG. 7). As will be very evident, the high-asymmetry 96×12 text is surprisingly good, particularly considering that it was a "first pass" attempt with completely standard elements and has not been optimized even as to ink properties—including viscosity and surface tension.

An added advantage of single-column printing is that it is free of edge roughness due to odd/even-nozzle scanaxis directionality effects. This benefit is due to the fact that the nozzles are all in one column, not staggered left and right as in the symmetrical-resolution, dual-column case.

For text this system does have a potential weakness relating to the text left and right edges (assuming portrait page orientation). In the center of each character stroke in text, ink coalescence is good—but at the left and right edges, it can be difficult to reliably induce the ink to merge into a smooth vertical edge, when that ink is placed at the relatively coarse 12 dot/mm spacings.

This potential difficulty can be overcome for black text by firing a cyan dot from the same die, along the lateral text edges. The liquid from the cyan helps merge the black ink dots above and below, and the cyan color is lost in the black and so not visually detectable.

A photo-quality option can be provided at extremely modest added cost. Two additional pen bays 22, 24 (FIGS. 1 and 2) can be reserved for parallel provision of dilute inks in additional, identical biphod pen bodies serving identical split-usage THAs 41. Naturally the four added channels require related electronics and software.

Alternatively, the two dilutions can be placed in a common biphod pen body, for each ink respectively—leading to a pen configuration appearing superficially exactly as in FIG. 2 of the Holstun patent. In this case, however, each pen is a biphod type holding not one dilution of two different colors but instead two different dilutions of the indicated ink color.

4. OTHER PREFERRED EMBODIMENTS

As previously indicated the invention is not limited to a scanning-pen incremental printer. Preferred embodiments are also applicable to a page-wide incremental printer which has a chassis 210 (FIG. 8) that supports a transverse inkjet array or other incremental marking array 222 extending fully across the printing medium.

The print medium is driven by a mechanism, symbolically indicated by an arrowhead 215, in a direction perpendicular to the transverse extension of the marking array 222. If preferred, the printing medium can instead be held stationary in the chassis 210, and a gantry-mounted marking array driven along the stationary printing medium. Any such relative-motion arrangement can be suitable.

In the case of a vertical-scan page-wide system as in FIG. 8—with the scan direction rotated ninety degrees in comparison with the horizontal-scan pen-carriage system—the pixel structure too is advantageously rotated. Preferably the finer-resolution direction of the asymmetrical pixels is parallel to the scan direction. Thus the overall, square-pixel width 252 and height 254 are now ten (for example) times the height 259 of each subpixel 250.

Moreover the geometry adopted for biphod ink feed through the THA die is not limited to the edge-feed arrangement of Keefe. To the contrary, provision of more centrally located channels 397 (FIG. 10) offers different ink-flow and heat-flow characteristics that can be beneficial in some designs.

Figure 10:
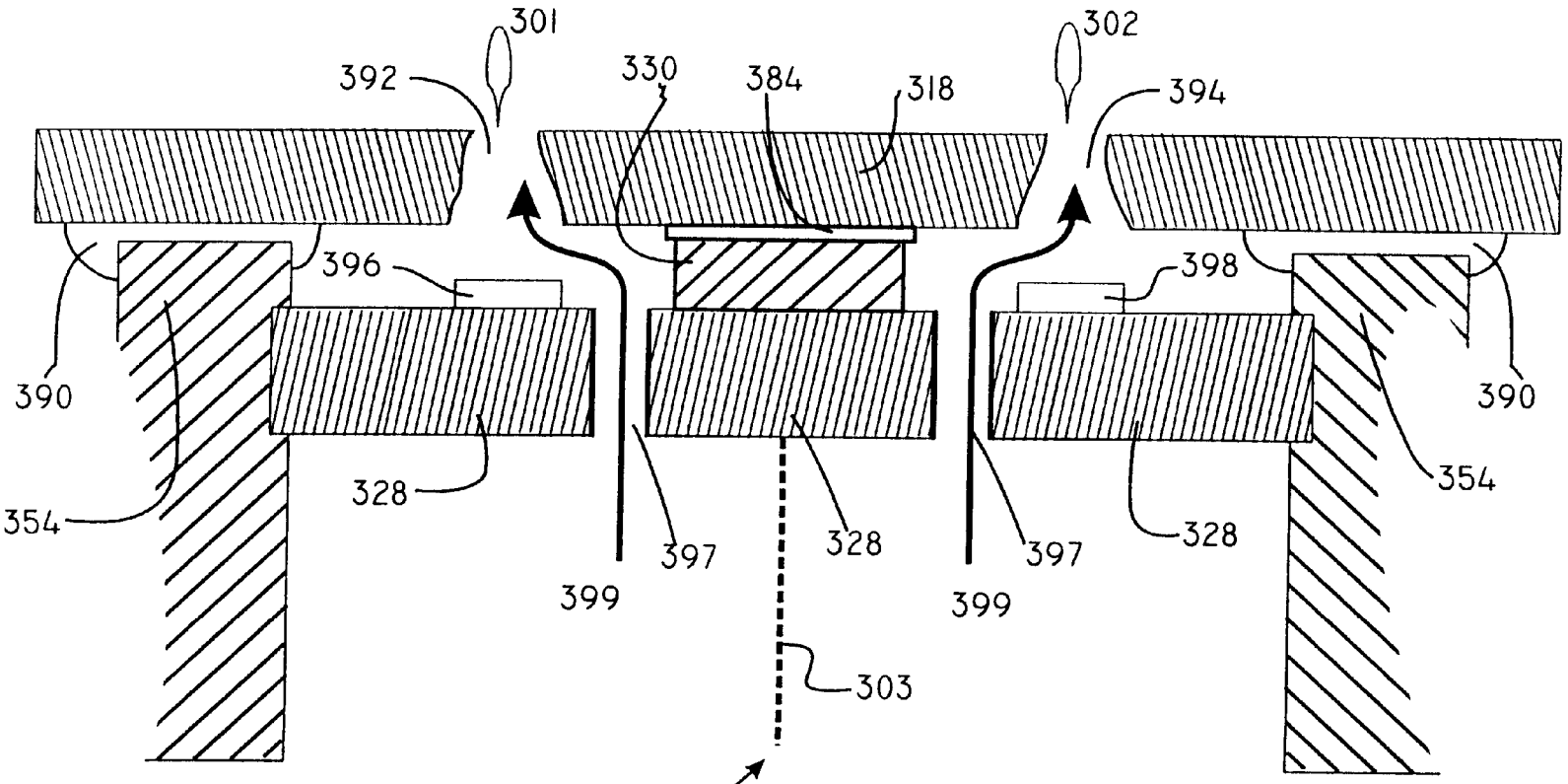
FIG. 10 is a cross-sectional diagram after Keefe, U.S. Pat. No. 5,278,584 (FIG. 9 therein), but directed to an alternative central-channel ink feeding geometry.

All other callouts in FIG. 10 are the same as in FIG. 9 of Keefe, except for use of a prefix "3" at the beginning of each reference numeral. Hence the components in present FIG. 10 may be understood by reference to the discussion in Keefe.

The above disclosure is intended as merely exemplary, and not to limit the scope of the invention—which is to be determined by reference to the appended claims.

What is claimed is:

1. Incremental-printing apparatus comprising:

means for establishing an actual pixel grid having a ratio of two orthogonal actual pixel dimensions that is at least four; and means for addressing marks of a single particular ink type to all pixels of the grid.

2. The apparatus of claim 1, for printing on a printing medium, and further comprising:

a marking array; and means for providing substantially continuous relative motion, along a relative-motion direction, between the marking array and the printing medium; and wherein a smaller of the orthogonal pixel dimensions is along the relative-motion direction.

3. The apparatus of claim 2, wherein:

the marking array comprises a page-wide marking array; and the two orthogonal pixel dimensions are pixel width and pixel height, respectively.

4. The apparatus of claim 3, wherein:

the relative-motion direction is substantially vertical with respect to the finished image.

5. The apparatus of claim 3, wherein:

the relative-motion providing means comprise means for advancing the printing medium under the page-wide marking array.

6. The apparatus of claim 2, wherein:

the marking array comprises a laterally scanning printhead; and the two orthogonal pixel dimensions are pixel height and pixel width, respectively.

7. The apparatus of claim 2, wherein:

the relative-motion providing means comprise means for providing, with respect to each portion of the printing medium, exactly one pass of said relative motion between the marking array and the printing medium.

8. The apparatus of claim 1, wherein:

the ratio is at least six.

9. The apparatus of claim 1, wherein:

the ratio is at least eight.

10. The apparatus of claim 1, wherein:

the establishing means comprise at least one array of marking elements, said elements being spaced apart along a media advance axis by a first distance, and means for displacing the array of marking elements along a scan axis; and the addressing means comprise means for, concurrently with operation of said displacing means, operating the marking elements to apply the colorant when the marking elements are at positions spaced apart along the scan axis by a second distance;

wherein said ratio is equal to the first distance divided by the second distance.

11. The apparatus of claim 10, wherein:

the first distance is at least six times the second distance.

12. The apparatus of claim 10, wherein:

the first distance is at least eight times the second distance.

13. The apparatus of claim 10, wherein:

the array of marking elements comprises plural subarrays of marking elements for each of plural colorant types respectively.

14. The apparatus of claim 10, wherein:

the at least one array of marking elements comprises plural arrays of marking elements for each of plural colorants respectively; and at least one of the arrays in turn comprises plural subarrays of marking elements for each of plural colorant dilutions respectively.

15. The apparatus of claim 10, wherein:

the at least one array comprises an inkjet printhead or part of an inkjet printhead; and each of the marking elements comprises, defined in the printhead, an inkjet nozzle and means for ejecting ink from the nozzle.

16. The apparatus of claim 10, wherein:

the at least one array comprises an inkjet pen;

the pen comprises at least one single, unitary tab-head assembly defining nozzles for firing ink of plural types; and the pen further comprises plural ink-supply means for supplying said ink of plural types to plural groups, respectively, of the nozzles.

17. The apparatus of claim 16, wherin:

the at least one single, unitary tab-head assembly defines said nozzles in plural staggered parallel columns of nozzles; and plural ink-supply means for supplying said ink of plural types to the plural staggered colums respectively.

18. Incremental-printing apparatus according to claim 1 and further comprising:

at least one single, unitary tab-head assembly having a die with ink-supply channels defined therein, and having a tape with nozzles defined therein, for firing ink of plural types;

at least one inkjet pen body comprising plural ink-supply means connected to supply said ink of plural types to plural groups, respectively, of the nozzles; and means, defined within the tab-head assembly die, for conducting ink from the plural ink-supply means to the plural groups of the nozzles, respectively, along channels substantially centrally defined through the die.

19. The apparatus of claim 18, wherein:

the at least one pen body comrises at least two pen bodies for discharging ink of, respectively, at least two pluralities of ink types.

20. The apparatus of claim 18, wherein:

the at least one pen body comprises at least four pen bodies for discharging ink of, respectively, at least four pluralities of ink types.

21. The apparatus of claim 20, wherein:

the at least four pluralities of ink types comprise inks of at least two different colors, and plural dilutions of at least one ink of a particular color.

22. The apparatus of claim 18, wherein the plural ink-supply means are selected from the group consisting of:

plural ink-storage chambers within each pen body; and plural ink-conveyance tubes extending from within each pen body to receive ink from plural external ink sources, respectively.

23. An incremental-printing method, for use with an array of marking elements that are spaced apart along a media advance axis by a first distance; said method comprising the steps of:

for colorant of a particular color, displacing the array of marking elements along a scan axis; and concurrently with the displacing step, operating the marking elements to apply the colorant when the marking elements are at each of plural successive positions spaced apart along the scan axis by a second distance;

wherein the first distance is at least four times the second distance.

24. The method of claim 23, wherein:

the first distance is at least six times the second distance.

25. The method of claim 23, wherein:

the first distance is at least eight times the second distance.

* * * * *